United States Patent [19]

Cramer et al.

[11] 4,404,082

[45] Sep. 13, 1983

[54] BIPOLAR ELECTRODE FOR ANODIC PROCESSES IN UNDIVIDED CELLS

[75] Inventors: Jürgen Cramer, Eppstein; Rudolf Pistorius, Ober-Mörlen; Michael Mitzlaff, Bad Homburg, all of Fed. Rep. of Germany

[73] Assignee: Hoechst Aktiengesellschaft, Frankfurt am Main, Fed. Rep. of Germany

[21] Appl. No.: 46,494

[22] Filed: Jun. 7, 1979

[30] Foreign Application Priority Data

Jun. 10, 1978 [DE] Fed. Rep. of Germany ..... 2825494

[51] Int. Cl.[3] ..... C25B 11/12; C25R 11/04

[52] U.S. Cl. ..... 204/290 R; 204/268; 204/72

[58] Field of Search ..... 204/290 R, 290 F, 290 H, 204/294, 268

[56] References Cited

U.S. PATENT DOCUMENTS

| | | | |
|---|---|---|---|
| 3,597,337 | 8/1971 | Jaksic et al. | 204/45 |
| 3,969,215 | 7/1976 | Zievers | 204/276 |
| 4,048,047 | 9/1977 | Beck et al. | 204/270 |
| 4,071,429 | 1/1978 | Wagenknecht et al. | 204/231 |
| 4,139,447 | 2/1979 | Faron et al. | 204/239 |

FOREIGN PATENT DOCUMENTS

| | | | |
|---|---|---|---|
| 186981 | 11/1966 | U.S.S.R. | 204/268 |

*Primary Examiner*—F. Edmundson

*Attorney, Agent, or Firm*—Curtis, Morris & Safford

[57] ABSTRACT

Bipolar electrodes of graphite or glassy carbon are provided on the cathode side with metal nets of a material reducing the hydrogen overvoltage, such as nickel, copper, titanium, steel or brass and between the metal nets and the next anode a spacer made of an insulating material is inserted.

10 Claims, 1 Drawing Figure

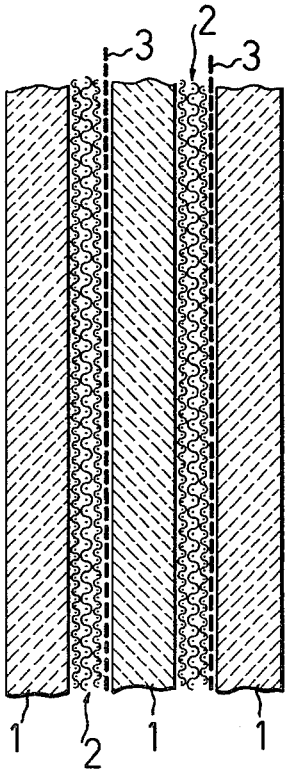
2
3
3
1
2
1
1

BIPOLAR ELECTRODE FOR ANODIC PROCESSES IN UNDIVIDED CELLS

This invention relates to a bipolar electrode of graphite or glassy carbon for the methoxylation of organic compounds.

It has been proposed to carry out anodic oxidation and methoxylation reactions in undivided cells using carbon electrodes (cf. for example DE-OS No. 2,502,167; DE-OS No. 2,547,386; Acta Chem. Scand., volume 29, pages 617–621 (1975) and BE-PS No. 836,949). When, in these processes, carbon electrodes are used in bipolar connection in order to produce large amounts of substance with industrially interesting space-time-yields, the hydrogen formed causes erosion at the cathodes when graphite is used. As a result of the erosion graphite particles can break away from the cathodes, which particles may cause short-circuits in the narrow electrode gaps, so that the current efficiency is diminished and considerable troubles in the operation of the cell do occur. Using glassy carbon as electrode material instead of graphite, erosion does not occur but during electrolysis the current efficiency decreases gradually.

It is, therefore, the object of the present invention to improve a bipolar electrode of carbon in such a manner that, on the one hand, the electrode is not worn away at the cathode by hydrogen evolution and, on the other, the current efficiency during electrolysis is maintained.

According to the invention, an improved bipolar electrode of carbon is provided, especially of graphite or glassy carbon, for anodic processes in undivided cells, which electrode is characterized in that the cathode side of the electrode is covered with metal nets made of a material reducing the hydrogen overvoltage. The invention also provides a process for using electrodes of the aforesaid improved type for carrying out anodic reactions in organic electrochemistry in undivided electrolytic cells, especially for methoxylation reactions.

Materials reducing the hydrogen overvoltage and suitable for the metal nets of the electrode according to the invention are mainly the metals of subgroups I, IV, V, VI and VIII of the Periodic System of the Elements. For economical reasons, the non noble metals are preferred such as, for example, nickel, copper and titanium, as well as steel and brass, preferably nickel and stainless steel.

The term "metal" net in the sense of the present invention is intended to include metal nets and fabrics and expanded metals. Cross sectional areas of the metal of from 0.002 $mm^2$ to 9 $mm^2$ proved to be suitable, preferably, however, from 0.008 $mm^2$ to 9 $mm^2$.

According to the requirements of the respective electrolysis, the electrode according to the invention can be provided with one or several layers of the net if only care is taken that the electrical field cannot pass through to the carbon plate. In the case of several layers these may be of the same type or of different types. The mesh widths and wire thicknesses of the metal nets or metal fabrics can vary within wide limits. The wire should have a diameter of from 0.05 mm to 1 mm, preferably 0.1 to 0.4 mm and the mesh widths should be in the range of from 0.1 to 5 mm, preferably 0.2 to 0.7 mm. The expended metals can be produced from sheet metal having a thickness of from 0.3 to 3 mm with land widths of from 0.5 to 3 mm, mesh widths of from 0.5 to 4 mm and mesh lengths of from 1 to 6 mm.

According to a preferred embodiment of the electrode of the invention, 2 to 3 layers of a net of stainless steel with a mesh width of 0.5 mm and a wire thickness of 0.3 mm are placed one upon the other and wrapped in a fine metal net having a mesh width of 0.19 mm and a wire thickness of 0.1 mm and the whole is laid on the cathode side of the plates of glassy carbon or graphite.

The electrode according to the invention is illustrated by way of example in the accompanying drawing representing a cross sectional view. In the sole figure, numeral 1 designates the carbon plate, 2 designates the metal nets on the cathode side and 3 are spacers of insulating material.

The electrode according to the invention has a long service life and can be operated with high and industrially interesting current densities of the electrolysis of up to 1 $A/cm^2$. The considerable amount of heat generated at such high current densities can be readily dissipated when the carbon plates are provided with sufficiently thick layers of metal net, metal fabric and/or expanded metal and a sufficient volume of electrolyte is allowed to pass through the electrode gaps. In this manner the danger of heat accumulation in the electrode gaps is avoided so that the cell can be operated with a minimum electrode distance and noticeable losses of energy in the electrolyte do not occur.

The following Examples illustrate the invention.

EXAMPLE 1

An undivided cell with anode of glassy carbon, cathode of nickel and in between two bipolar connected electrodes of glassy carbon was mounted in a flow apparatus with circulating pump, heat exchanger and degassing vessel. Between the electrode plates was inserted an assembly of nickel fabric (two layers of a mesh width of 0.19 mm and a wire thickness of 0.1 mm and in between two layers of a mesh width of 0.5 mm and a wire thickness of 0.3 mm) and polyethylene fabric (one layer with a mesh width of 0.9 mm and a thickness of the filaments of 0.3 mm) in such a manner that the nickel fabric was in contact with the cathode sides of the carbon plates and with the nickel electrode and before mounting the whole structure was pressed together. All electrode plates were fitted in a polyethylene frame which had a width of 22 mm vertical to the direction of flow of the electrolyte, of 12 mm parallel to the direction of flow and a thickness of about 2.5 mm like the plates. Each anode had an effective electrode surface of 255 $cm^2$.

In this cell a mixture of 3,220 g of benzene. 391 g of tetramethylammonium fluoride, 49 g of hydrogen fluoride and 10,340 g of methanol was electrolyzed for 17 hours and 45 minutes at 35° C. at 51 A and 17.5 to 18.9 volts (corresponding to 2,120 Ahr). After this time, the electrolyte contained 7.42 mols of p-benzoquinone tetramethyl ketal, corresponding to a current efficiency of 43.9% of the theory.

COMPARATIVE EXAMPLE

An electrode assembly consisting of an anode of glassy carbon, a nickel cathode and with two bipolar connected electrodes of glassy carbon inserted between anode and cathode was fitted in the undivided cell of the apparatus as used in Example 1. The bipolar connected electrodes and the outer electrodes were framed as described in Example 1. Polyethylene nets of a mesh width of 3×5 mm and a thickness of the filaments of 0.5 mm had the function of spacers between the plates. In this experiment, thicker nets with a greater mesh width were used in order to obtain a free volume between the plates comparable to that in Example 1. The larger electrode distance thus obtained was compensated by a higher concentration of supporting electrolyte whereby the conductivity of the electrolyte was improved. In this cell, a mixture of 1,050 g of benzene, 380 g of tetramethylammonium fluoride, 10 g of hydrogen fluoride and 4,340 g of methanol was electrolyzed for 12 hours at 50 A (corresponding to 1,800 Ahr) and 19 to 22 volts. After said time, the electrolyte contained 0.40 mol of p-benzoquinone tetramethyl ketal, corresponding to a current efficiency of 3.6% of the theory.

EXAMPLE 2

6 round, bipolar connected graphite disks (type Diabon(R) N of Messrs. Sigri, Meitingen, Federal Republic of Germany) having a diameter of 50 mm and a thickness of 21 mm were fitted in a glass tube having an internal diameter of 50 mm and in between each two of the disks a nickel net (mesh width 0.5 mm, wire thickness 0.3 mm) and a polyethylene net (mesh width 1.8 mm and filament thickness 0.6 mm) were inserted in such a manner that the nickel nets were on the cathode side. The graphite disks were provided each with 56 perforations having a diameter of 1.5 mm through which the electrolyte could flow. The glass tube was closed by graphite plates which had similar perforations and acted as contact electrodes. The cell was fitted in a flow apparatus with circulating pump, heat exchanger and degassing vessel. In this device, a mixture of 350 g of o-chloroanisol, 139 g of tetramethylammonium fluoride, 3.17 g of hydrogen fluoride and 2,900 g of methanol was electrolyzed for 4 hours and 50 minutes at 5 A (corresponding to 169 Ahr), 37 to 43.4 volts and 34° to 35° C. After said time, the electrolyte contained 181 g of chloro-p-benzoquinone tetramethyl ketal, 71.1 g of chlorohydroquinone dimethyl ether and 124 g of unreacted starting product.

COMPARATIVE EXAMPLE

In the apparatus as described in Example 2 the metal nets were removed and the mixture described in said example was electrolyzed two times successively. After a total of 223 Ahr, the voltage in the cell had dropped from 38 volts to 27 volts. The electrolysis was then interrupted and the cell was opened. Graphite particles had collected between two of the plates and had caused short circuits.

EXAMPLE 3

In the flow apparatus with cell as described in Example 1 a mixture of 4,800 g of 1-formylpiperidine, 13,600 g of methanol and 68 g of tetramethylammonium tetrafluoroborate was electrolyzed at 27.5 A, 42 volts and 25° C. for 27 hours and 33 minutes (corresponding to 2,273 Ahr). After distillative work up, 5,720 g of 1-formyl-2-methoxypiperidine were isolated, corresponding to a current efficiency of 86.9%.

COMPARATIVE EXAMPLE

An electrode assembly consisting of an anode of glassy carbon, a nickel cathode and two bipolar connected electrodes of glassy carbon inserted between the two outer electrodes was fitted in the cell of the device as described in Example 1. All four electrodes were framed as described in Example 1. Polyethylene nets (mesh width 3×5 mm and thickness of filaments 0.5 mm) between the plates had the function of spacers. In this cell, a mixture of 4,800 g of 1-formylpiperidine, 13,600 g of methanol and 68 g of tetramethylammonium tetrafluoroborate was electrolyzed at 27.5 A, 45 volts and 25° C. for 27 hours and 33 minutes (corresponding to 2,273 Ahr). After distillative work up, 5,120 g of 1-formyl-2-methoxypiperidine were isolated, corresponding to a current efficiency of 80.3%.

EXAMPLE 4

In the cell and device as described in Example 2 a mixture of 480 g of 1-formylpiperidine, 1,360 g of methanol and 6.80 g of tetramethylammonium tetrafluoroborate was electrolyzed for 34 hours and 15 minutes at 1 A (corresponding to 240 Ahr), 98 volts and 25° C. By distillative work up, 577 g of 1-formyl-2-methoxypiperidine could be isolated from the clear electrolyte, corresponding to a current efficiency of 90.2% of the theory.

COMPARATIVE EXAMPLE

The metal nets were removed from the cell as described in Example 2 and a mixture of 480 g of 1-formylpiperidine, 1,360 g of methanol and 6.80 g of tetramethylammonium tetrafluoroborate was electrolyzed for 40 hours and 40 minutes at 1 A (corresponding to 285 Ahr), 105 volts and 25° C.

After a short period of electrolysis, the turbidity of the initially limpid electrolyte increased gradually due to fine abraded graphite particles. After distillative work up, 476 g of 1-formyl-2-methoxypiperidine could be isolated, corresponding to a current efficiency of 62.7%.

What is claimed is:

1. Bipolar electrode of carbon, characterized in that the cathode side of said bipolar electrode is covered with metal nets in contact therewith consisting of a material reducing the hydrogen overvoltage.

2. Bipolar electrode as claimed in claim 1, wherein the material reducing the hydrogen overvoltage is selected from the grouping consisting of nickel, copper, titanium, steel and brass.

3. Bipolar electrode as claimed in claim 2, wherein the material reducing the hydrogen overvoltage is nickel.

4. Method of using the bipolar electrode as claimed in claim 1 for anodic reactions in organic electrochemistry in undivided electrolytic cells.

5. Bipolar electrode as claimed in claim 1, wherein said carbon electrode is formed of graphite.

6. Bipolar electrode as claimed in claim 1, wherein said carbon electrode is formed of glassy carbon.

7. Bipolar electrode as claimed in claim 2, wherein the material reducing the hydrogen overvoltage is stainless steel.

8. Bipolar electrode assembly comprised of a plurality of parallel electrode plates, each said plate being formed of carbon and having an anode surface and a cathode surface, characterized in that adjacent electrode plates are separated by metal nets, said metal nets being in contact with the cathode surface of one electrode plate and consisting of a material reducing the hydrogen overvoltage, and a spacer of insulating material is interposed between said metal nets and the anode surface of the next adjacent electrode plate.

9. Bipolar electrode assembly as claimed in claim 8, wherein said metal nets are comprised of at least one layer of wire mesh said wire having a diameter in the range of from 0.05 mm to 1 mm and a mesh width in the range of from 0.1 mm to 5 mm.

10. Bipolar electrode assembly as claimed in claim 9, wherein said metal nets are comprised of plural layers of wire mesh.

* * * * *